United States Patent [19]

Sixsmith

[11] Patent Number: 4,706,729

[45] Date of Patent: Nov. 17, 1987

[54] INTERIOR STORM WINDOW

[76] Inventor: Thomas Sixsmith, 22016 Buenaventura St., Woodland Hills, Calif. 91364

[21] Appl. No.: 409,063

[22] Filed: Aug. 18, 1982

[51] Int. Cl.[4] ..... A47H 3/00

[52] U.S. Cl. ..... 160/369; 160/215

[58] Field of Search ..... 160/179, 40, 105, 215, 160/217, 229 R, 230, 354, 368 R, 369

[56] References Cited

U.S. PATENT DOCUMENTS

| | | | |
|---|---|---|---|
| 931,421 | 8/1909 | Henry | 160/105 |
| 1,942,776 | 1/1934 | Schafer | 160/369 |
| 2,598,770 | 5/1952 | Drozt | 160/105 |
| 2,612,947 | 10/1952 | Jenks | 160/354 |
| 2,817,399 | 12/1957 | Donaldson et al. | 160/179 |
| 3,096,816 | 7/1963 | Peters | 160/215 |
| 3,760,860 | 9/1973 | Kelarakis | 160/179 |
| 3,948,308 | 4/1976 | Facey | 160/369 |

*Primary Examiner*—Ramon S. Britts
*Assistant Examiner*—David M. Purol
*Attorney, Agent, or Firm*—William J. Ruano

[57] ABSTRACT

An interior storm window that comprises a frame having one or more panels with outer and inner covers of double polished virgin vinyl plastic film with an air space therebetween. The outer frame edge is tapered at an angle of about 20° and a strip of polyurethane foam is attached to the outer frame edge so that a progressively tighter friction fit is provided with the interior window frame of a house or other building. The storm window, particularly for large window frames, is in the form of two or more panels hinged together and locked together while in the same plane. A single foam edge may be provided on one of the pivoted window panels that adjoins the other.

2 Claims, 3 Drawing Figures

INTERIOR STORM WINDOW

This invention relates to an interior storm window for homes and other buildings.

An outstanding disadvantage of storm windows is that they require fastening means, such as bolts and screws, to attach them in spaced relationship to the interior or exterior of a window frame. These have added to the cost as well as making it difficult, particularly for women, to install.

Another disadvantage is that for large windows, the frame structure becomes unwieldly to handle and to store.

Another disadvantage is that traditional storm windows are made of single panes and do not provide the needed "dead air space".

An object of the present invention is to overcome the above-named disadvantages.

A more specific object of the invention is to provide a novel interior storm window that is easy to install and to remove and which can be stacked by direct contact with adjoining storm windows, without the intervention of fasteners, such as bolts, etc.

Another object of the invention is to provide two dead air spaces—one inherent between the layers of plastic and one created between the primary window and the first layer of the interior storm window.

Other objects and advantages of the invention will become more apparent from the following description taken with the accompanying drawing wherein.

Figure 1:
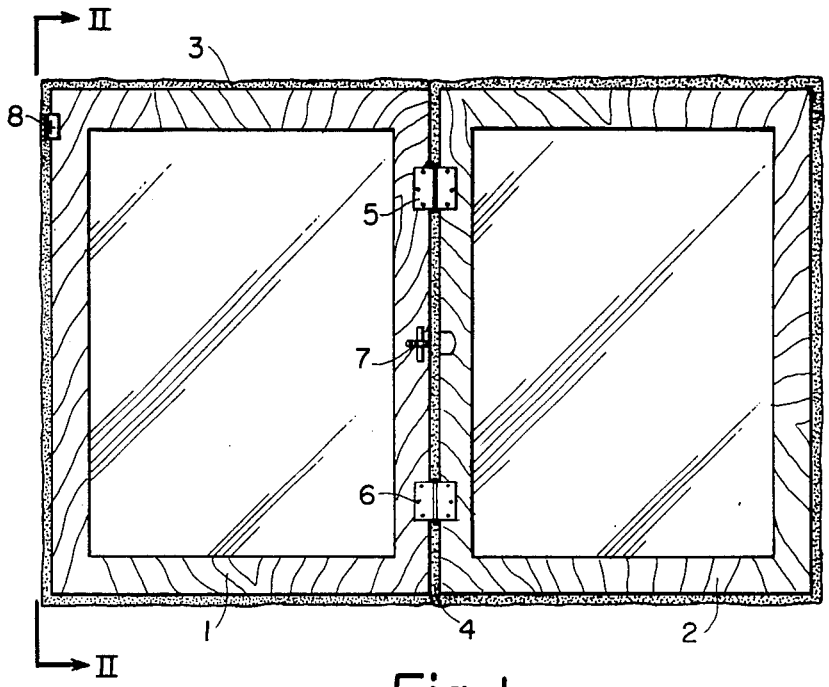
FIG. 1 is an elevational view of an interior storm window assembly having double panels and embodying the principles of the present invention.
Figure 2:
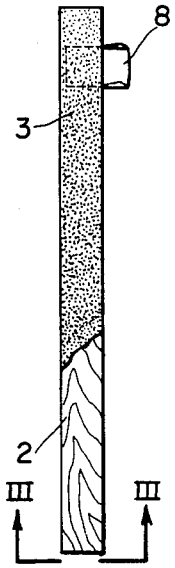
FIG. 2 is a side view taken from the left of FIG. 1 showing the outer foam partly cut away.

Referring more particularly to FIG. 1 of the drawing, numerals 1 and 2 denote two rectangular frames of wood or other material, such as plastic, aluminum, etc. On each side of frames 1 and 2 there is adhered a polished virgin vinyl plastic film which will cover the entire frame and a portion of the outer edge thereof, thereby providing spaced sheets of plastic material with a sealed air space therebetween.

Figure 3:
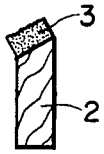
FIG. 3 is a fragmentary view taken along the bottom of FIG. 2.

As best seen in FIG. 3, the entire perimeter of the assembly shown in FIG. 1 is provided with a taper or angle of about 20°. Thereafter, a strip 3 of foam material, such as polyurethane foam is glued or pressure-sensitively adhered to along the entire outer perimeter of the double frame shown. There is also an edging of foam 4 which is attached only to one of the frames, it not being necessary for the other. The frame has its panels hinged together by hinges 5 and 6 working against the cushion provided by foam strip or edging 4. A camming locking mechanism 7 is provided for locking together panels 1 and 2 when located in the same plane.

Strips of plastic material 8 to form pull tabs are folded with ends adjoining each other and which ends are rigidly attached to the frames 1 and 2 between the foam strip 3 and the frame of wood or other material. Thus by inserting the forefingers in the loops provided by pull tabs 8, it is possible to get a firm hold on the frame assembly and pull it out from the window frame (not shown) to which the interior storm window is frictionally attached by the bevel on the leading edge of the outer perimeter of the frame.

Therefore, since the frame is devoid of any projecting surfaces, when it is removed from the interior of the house window frame, it can be stacked onto other similar frames and make direct contact therewith without intervention of handles or the like. While a double storm window is shown for use in large windows, it will be readily apparent that a single pane may be used for a smaller window, for example by omitting the hinges 5 and 6 and lock 7 and employing only the panel which has a foam strip on both side edges.

Thus it will be seen that I have provided an efficient interior storm window of a construction to enable easy installation by a friction fit along the outer perimeter of existing window frame, and which can be easily removed simply by inserting the fingers in plastic loops or pull tabs fastened on opposite side edges (or top and bottom edges) of the storm window; furthermore, I have provided an interior storm window assembly devoid of any projections, therefore which can be directly stacked on other similar panels for storage purposes; while storm windows have been described, the same frame structure could be used for screens; also I have provided a significant improvement in the insulating features of the storm window by providing two dead air spaces—one inherent between the layers of plastic and one created between the primary window and the first layer of the interior storm window.

While I have illustrated and described a single specific embodiment of my invention, it will be understood that this is by way of illustration only and that various changes and modifications may be contemplated in my invention within the scope of the following claims.

I claim:

1. An interior storm window comprising a frame having a rectangular outer edge which is beveled at about an angle of 20° with the horizontal, said frame having an inside and outside transparent plastic cover sealed along the edge between which there is contained a dead air space, a strip of foam plastic material surrounding said edge on all four sides, and constituting the sole fastening means between said frame and window, and a pair of pull tabs in the form of loops of material whose edges are fastened between said foam strip and window frame to enable easy grasping of the interior storm window for removal or for insertion into a window frame.

2. An interior storm window as recited in claim 1 wherein said frame is formed into two sub frames to provide two storm window panels, hinges for hinging adjoining sides of said panel together, a lock for locking said adjoining sides together while in a single plane, and an edging of foam plastic material between the adjoining hinged sides of the frame.

* * * * *